US005170734A

United States Patent [19]

Maguerez et al.

[11] Patent Number: 5,170,734

[45] Date of Patent: Dec. 15, 1992

[54] WIND PROPELLED CRAFT WITH MULTI-FUNCTION RUDDER CONTROL ARM

[76] Inventors: Georges Y. Maguerez, 2477 Overlook Rd., Cleveland Heights, Ohio 44106; Charles P. Maguerez, Laberwrach, 29214 Lamnilis, France

[21] Appl. No.: 583,482

[22] Filed: Sep. 17, 1990

[51] Int. Cl.[5] ..... B63H 25/06

[52] U.S. Cl. ..... 114/39.1; 114/144 R; 114/146; 114/162

[58] Field of Search ..... 114/39.1, 144 R, 162, 114/146, 93, 160, 161; 74/480 B, 493

[56] References Cited

U.S. PATENT DOCUMENTS

| | | | |
|---|---|---|---|
| Re. 31,167 | 1/1970 | Schweitzer et al. | 114/39 |
| 1,846,458 | 2/1932 | Robinson | 114/39 |
| 3,144,785 | 8/1964 | Steiner et al. | 74/493 |
| 3,349,741 | 10/1967 | Herbst | 114/39 |
| 3,707,935 | 1/1973 | Rachie | 114/39 |
| 3,858,542 | 1/1975 | Lenoble | 114/103 |
| 3,956,785 | 5/1976 | Halfon | 114/39.1 |
| 3,985,090 | 10/1976 | Rineman | 114/39.1 |
| 4,054,100 | 10/1977 | Rineman | 114/39 |
| 4,553,496 | 11/1985 | Foresman | 114/162 X |
| 4,563,967 | 1/1986 | Oksman | 114/39.1 |
| 4,679,516 | 7/1987 | Friesen | 114/93 |
| 4,771,723 | 9/1988 | Friesen | 114/39 |

OTHER PUBLICATIONS

The American College Dictionary, Random House, New York, Syracuse, 1970, p. 1327.

France-Marina-Noveau Poer des Issambres Brochure, "Piranha".

Brown, "Fast Forward", Sailing World, p. 52.

*Primary Examiner*—Sherman Basinger

*Attorney, Agent, or Firm*—Renner, Otto, Boisselle & Sklar

[57] ABSTRACT

A unique wind propelled craft including a body, a deck which forms the upper surface of the body, a sail for propelling the body by wind forces, a rudder for maneuvering the craft, and a rudder control assembly for controlling and adjusting the position of the rudder. The rudder control assembly includes a steering assembly and a pair of rotating steering members operably connected to the rudder for turning the rudder upon rotation of the steering members. Each of the steering members is adapted to releasibly engage the steering assembly at two separate locations along the deck. The steering assembly includes an elongated multi-function rudder control arm. The control arm includes at its distal end a grip for engagement with a user's hand and at its proximate end a universal joint assembly. The universal joint assembly allows a user to manipulate the control arm throughout an entire hemisphere of positions without effectuating any corresponding movement of the steering members or the rudder. Turning movement of the rudder is accomplished by rotating the grip, and in turn, the control arm.

17 Claims, 5 Drawing Sheets

WIND PROPELLED CRAFT WITH MULTI-FUNCTION RUDDER CONTROL ARM

DISCLOSURE

The present invention relates generally to wind-propelled craft and, more particularly, to a small sailboat having a unique multi-function rudder control arm assembly.

BACKGROUND OF THE INVENTION

Small sailing craft or sailboats heretofore have been equipped with rudders for controlling the direction in which the sailboat travels upon the water. In many of these sailboats a rudder located near the aft end of the sailboat's hull is controlled by a tiller extending forwardly from the rudder. The sailor usually sits on the hull forwardly of the tiller reaching back to hold the tiller with one hand while the other hand of the sailor holds a sheet line to control the set of the sail. Sailboats of this type are relatively easy to sail.

Other sailboats are designed for riding in surfboard fashion. In these sailboats, also known as windsurfers, a mast-boom-sail assembly enables steering of the sailboat without using a steerable rudder. The mast is coupled to a surfboard-like hull by a universal joint so that the mast can be tilted from vertical by a standing rider while the mast-boom-sail assembly is pivoted around the universal joint. The combined mast tilting, boom swinging and movement of the rider's body weight on the board can be used to turn the board.

Windsurfers add a high degree of excitement and enjoyment to sailing. This in part is attributed to the rider standing on the board and being able to move while standing from side-to-side to provide appropriate weight shifting. Unfortunately, a high level of skill is required to coordinate the tricky task of erecting the mast-boom-sail assembly and to maintain the assembly in a substantially vertical position while the wind force tends to knock the assembly down. Moreover, even a highly skilled user may expend considerable effort to control the mast-boom-sail assembly while trying to balance himself or herself on the board.

Another type of small sailboat where the user stands on the hull of the craft is disclosed in Rineman U.S. Pat. No. 3,985,090. Rineman '090 discloses a sailboat having a main hull, an outboard pontoon and a platform section between the main hull and outboard pontoon. A mast is positioned substantially medially and to one side of the main hull, and the main hull has rudders at each end which are controlled by a steering mechanism manually operated by the sailor normally standing on the web and platform section. The steering mechanism includes a steering lever that may be swung upwardly and downwardly to enable the sailor to brace and balance himself or herself upon the platform. For rudder control, the steering lever functions like a tiller, i.e., the steering lever is swung horizontally to turn the rudders.

A similar small sailboat may be found in Rineman U.S. Pat. No. 4,054,100. Like Rineman '090, Rineman '100 discloses a sailboat having rudders positioned near the fore and aft ends of the sailboat and steering is effected in the Rineman '100 sailboat by lateral movement of the steering lever. In both the Rineman '090 sailboat and the Rineman '100 sailboat the sterring lever is mounted at a single position along the deck of the hull.

SUMMARY OF THE INVENTION

The present invention provides a sailboat which gives the user much of the enjoyment and excitement of windsurfing without the high degree of skill and effort required to operate a conventional windsurfer. The sailboat is characterized by various novel features which facilitate the operation and use of the sailboat. These various novel features are most advantageously used in conjunction with a sailboard-like or surfboard-like hull, although they may have wider application to other watercraft such as catamarans and to other craft such as iceboats and landcraft.

According to one aspect of the invention, a wind propelled craft comprises a body having a deck for supporting a user, a sail attached by a mast to the body, a rudder for controlling the direction of movement of the body and a rudder control assembly including a steering assembly. The steering assembly includes a multi-function control arm which is capable of being moved laterally throughout a hemisphere of positions without affecting the position of the rudder. Adjustment of the position of the rudder is accomplished not by swinging the control arm, but rather by rotating the control arm about its longitudinal axis. Thus, the rudder control assembly allows a user to utilize the control arm for balance and support while moving around the deck without any concern as to whether or not altering the position of the control arm will impact upon the position of the rudder.

The invention also provides a rudder control assembly wherein the steering assembly may be readily detached from a coupling at a forward location on the body of the craft and attached to a coupling at a rearward location on the body proximate the rudder. When at its forward location the steering assembly allows a user to make better use of his or her weight in controlling and balancing the craft. At the rearward location the steering assembly is more conventionally located and may be directly coupled to the rudder or its supporting hardware as is desirable for emergency usage.

According to one preferred embodiment of the invention, the the invention provides a sailboat. The sailboat includes a hull for floating upon the water, a deck which forms at least a part of the upper surface of the hull, a sail assembly including a sail supported on a vertical mast extending substantially perpendicular to the deck of the hull, a rudder for maneuvering the sailboat within the water, and a rudder control assembly for allowing the user to control the position of the rudder. The rudder control assembly includes a steering assembly and a linking assembly connecting the steering assembly to the rudder. The linking assembly is adapted to receive and releasably engage the steering assembly at two separate locations along the deck. At the first location the steering assembly is in the proximity of the base of the vertical mast and at the second location the steering assembly is near the stern of the sailboat.

The steering assembly includes a base for attachment to the deck and an elongated telescoping multi-function control arm which extends from the base. Included at the distal end of the control arm is a grip for engagement by a user's hand. Included at the proximate end of the control arm is a universal joint assembly connecting the control arm to the base. The universal joint assembly allows a user to manipulate the control arm throughout a hemisphere of positions without effectuating any corresponding movement of the linking assembly or the rudder. Movement of the rudder is instead accomplished by the rotation of the grip and, in turn, the rotation of the control arm about its axis.

The foregoing and other features of the invention are hereinafter more fully described and particularly pointed out in the claims, the following description and the annexed drawings setting forth in detail certain illustrative embodiments of the invention, these being indicative, however, of but a few of the various ways in which the principles of the present invention may be employed.

DETAILED DESCRIPTION

Figure 1:
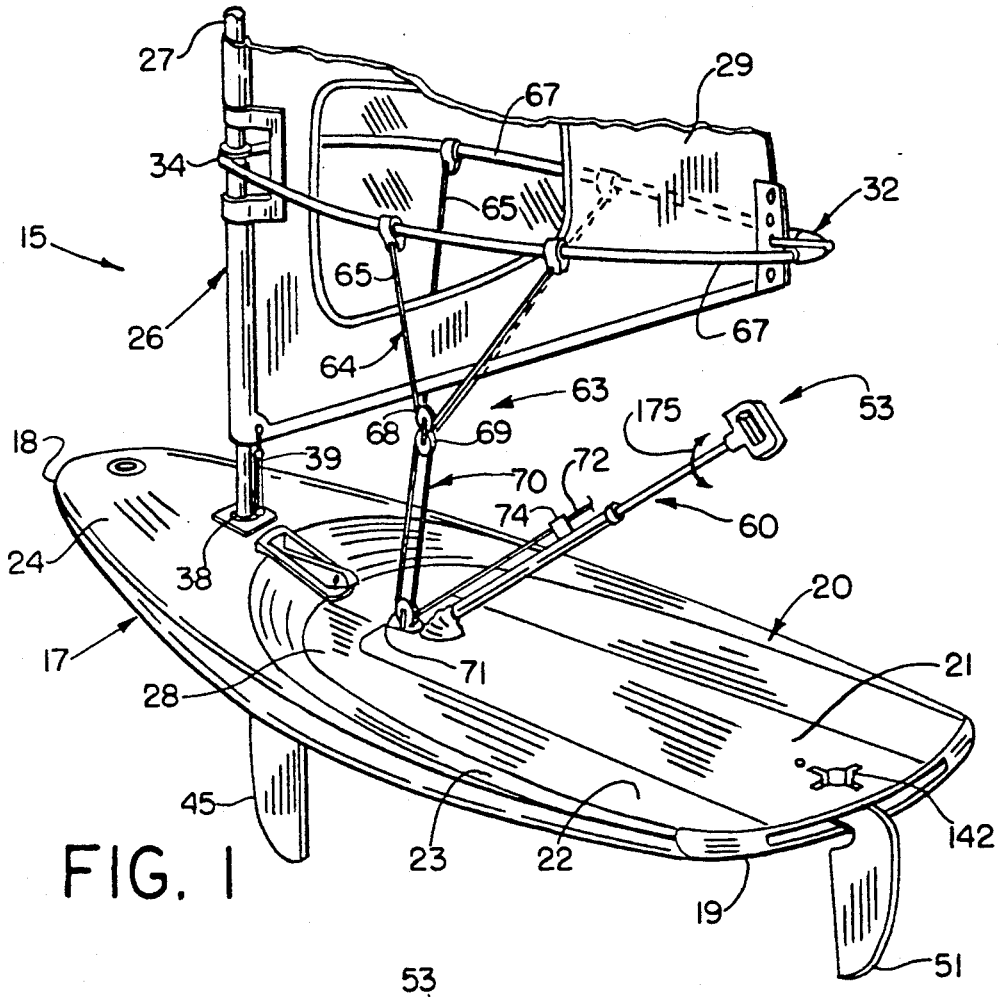
FIG. 1 is a perspective view of a sailboat made in accordance with the principles of the present invention.

Referring now in detail to the drawings and initially to FIG. 1, a preferred embodiment of a wind-propelled craft according to the invention can be seen to be a sailboat indicated at 15. The sailboat 15 is relatively small having a length of less than about twenty feet. The sailboat 15 includes a sailboard-like hull 17 having a fore end with a bow 18 and an aft end with a stern 19. The hull 17 has a deck 20 which forms the somewhat planar top surface of the hull 17. The deck 20 has a substantially flat rear deck portion 21 surrounded on three sides by slightly upwardly sloping deck portions 22 and 23. The deck also has a front deck portion 24.

The sailboat 15 further includes a sail assembly 26 having a mast 27 and a sail 29. The mast 27 is mounted between the bow 18 and the midsection 28 of the hull 17 and preferably extends substantially perpendicular to the longitudinal and transverse axes of the hull 17. The sail assembly 26 also includes a conventional wishbone boom assembly 32 which substantially encompasses the lower portion of the sail 29. The boom assembly 32 is pivotally secured to the vertical mast 27 by a rotatable collar or other suitable device 34.

The bottom end of the vertical mast 27 is received and firmly supported within a socket 38 provided in the front deck 24. The socket 38 facilitates the ready connection and disconnection of the vertical mast 27 to and from the hull 17. A conventional hold down rig 39 keeps the sail 29 from riding up the mast.

The sailboat 15 further includes a removable dagger board 45 that serves as a keel. The dagger board 45 extends through an opening formed in the sloping deck portion 23 and down below the bottom surface of the hull 17. Also extending below the bottom surface of the hull 17 is a rudder 51. The rudder 51 is located at the stern 19 of the sailboat 15. The position of the rudder 51 is controlled by a rudder control assembly 53 including a removable steering assembly 60. The steering assembly 60 extends from a first or forward location slightly ahead of the forward end of the rear deck 21, in the midsection 28 of the sailboat 15, between the vertical mast 27 and the stern 19 of the sailboat 15.

The sail assembly 26 also includes a sail control rig 63 for controlling the set or trim of the sail 29. The rig 63 includes a yoke harness 64 comprising a pair of lines 65 connected at their ends to respective booms 67 of the boom assembly 32. The lines 65 are trained around a pulley or pulleys 68 which are connected to the upper block 69 of a block and tackle assembly 70. The lower block 71 of the block and tackle assembly 70 is anchored to the deck 20 preferably by a swivel. A sheet line 72 extends from the lower block 71 which is preferably located near the lower end of the steering assembly 60. The free end of the sheet line 72 is threaded through a conventional quick release locking cleat 74 which is mounted on the steering assembly 60.

Figure 2:
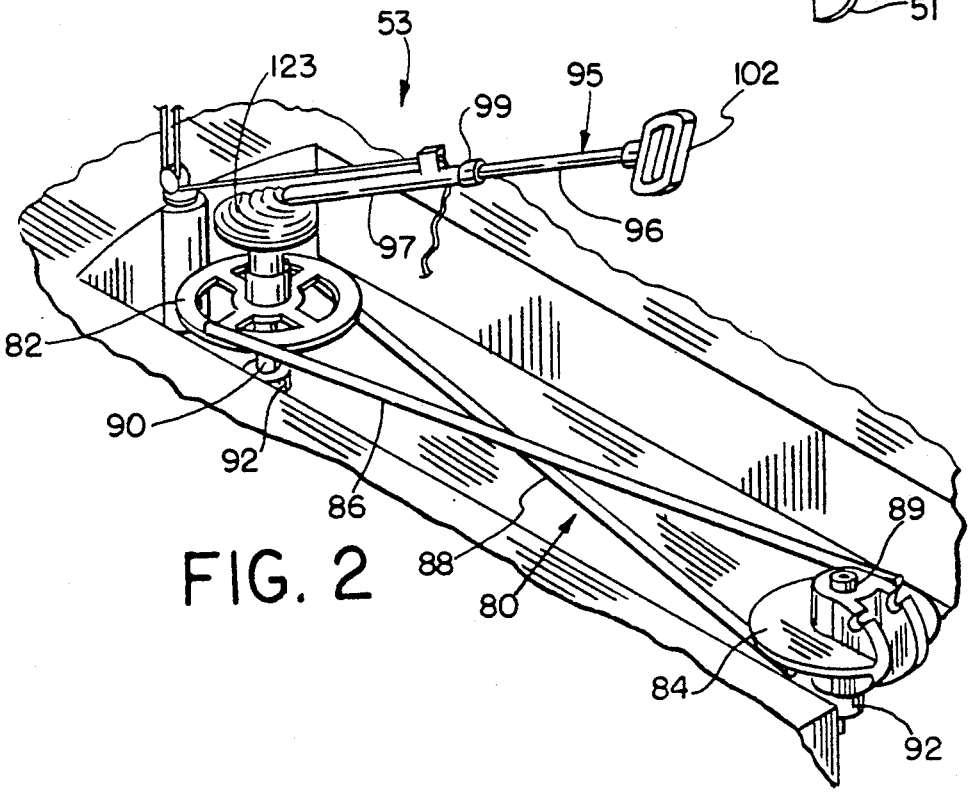
FIG. 2 is a exploded partially broken away view illustrating the rudder control assembly of the sailboat shown in FIG. 1.
Figure 3:
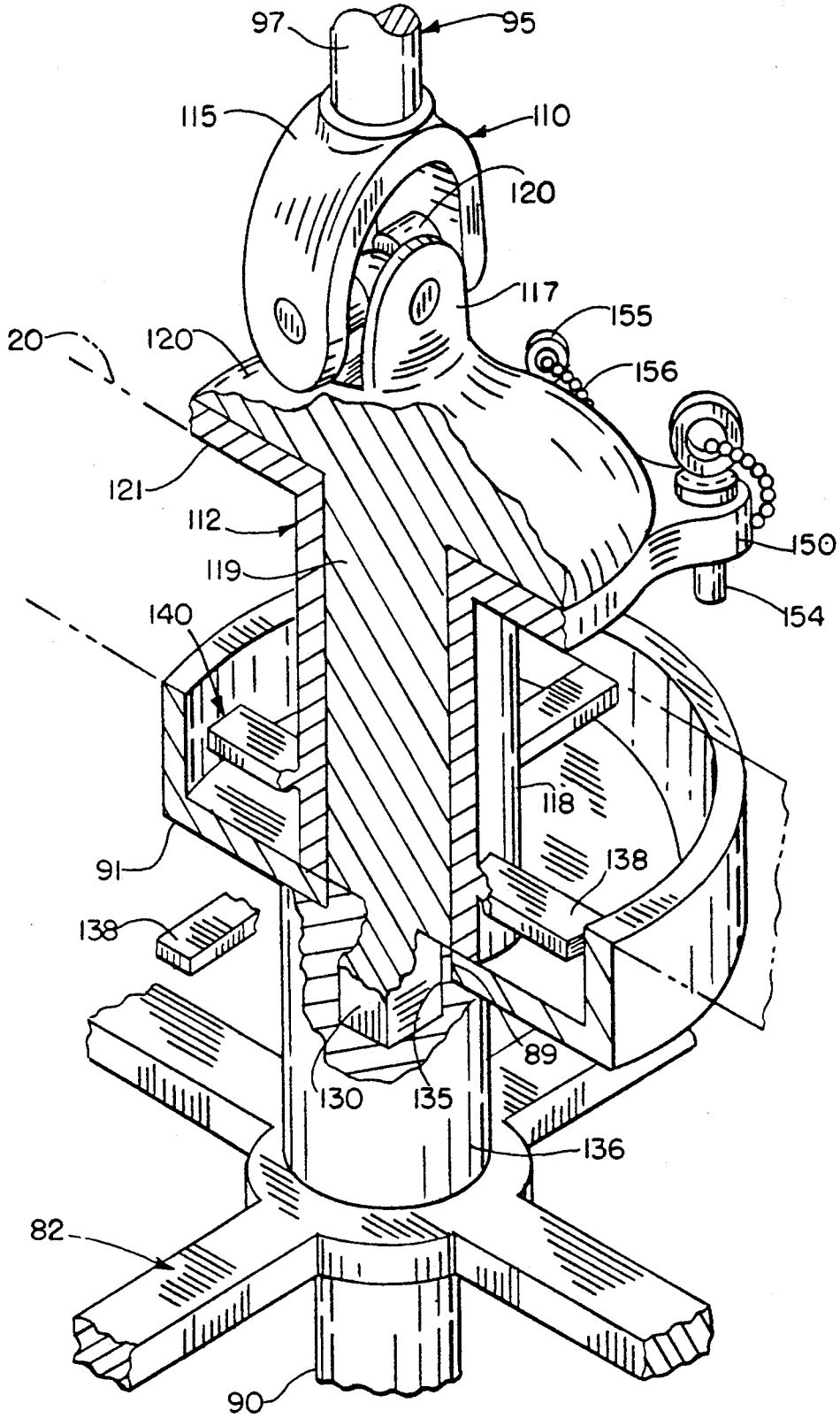
FIG. 3 is a perspective partial cross-sectional view of a portion of the linking assembly and the steering assembly of the sailboat of FIG. 1.
Figure 4:
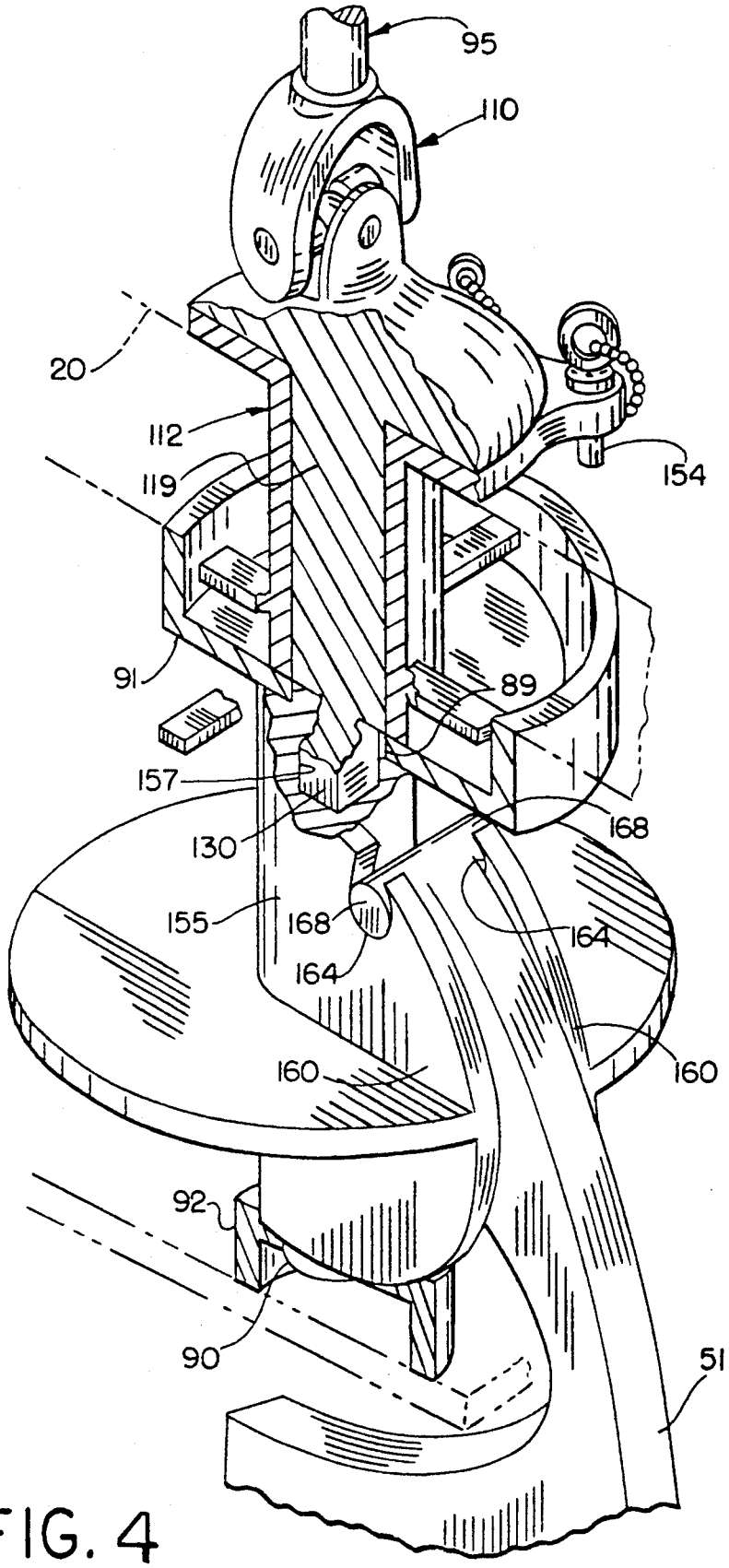
FIG. 4 is a perspective partial cross-sectional view of another portion of the linking assembly and the steering assembly of the sailboat of FIG. 1.

Referring now to FIGS. 2–4, there is more completely illustrated the rudder control assembly 53 for controlling the position of the rudder 51. As shown in FIG. 2, the rudder control assembly 53 includes a linking assembly 80 that connects the steering assembly 60 to the rudder 51. The linking assembly 80 comprises a pair of rotatable steering members or wheels 82 and 84 that are connected by a pair of rods 86 and 88 pivotally attached at their ends to the wheels 82 and 84. In addition to serving to transmit rotational forces, the wheel 84 serves to support the rudder 51 as shown in FIG. 4.

The rotatable steering members 82 and 84 each include vertically extending top and bottom journals 89 and 90 respectively supported for rotation by suitable top and bottom bearing supports 91 and 92 in the hull 17. The top and bottom bearing supports 91 and 92 serve to allow the rotatable steering members to rotate freely while maintaining their axes substantially perpendicular to the major horizontal axis of the hull 17 and, more importantly, parallel to one another.

The distal ends of the rods 86 and 88 are pivotally connected to the rotatable steering members 82 and 84 at diametrically opposed points spaced equally radially outwardly from the rotational axes of the rotatable steering members. Thus, when the front steering member 82 is rotated, the rods 86 and 88 transmit the rotational movement of the steering member 82 to the rear steering member 84, causing the rear steering member 84 to rotate in a similar manner but opposite direction as the front steering member 82. This particular construction allows the steering members 82 and 84 to rotate almost 90° in either direction from the center position depicted in FIG. 2.

Although in the illustrated embodiment the rods 86 and 88 are shown for transmitting rotational forces, it will be appreciated that the present invention contemplates the use of various alternative means for transmitting rotational forces between the front and rear steering members 82 and 84. For example, a chain or belt may be provided for encircling the steering members 82 and 84, or a pair of cables extending between the steering members may also be provided. Alternatively, the steering members 82 and 84 may be interconnected by a series of gears.

As shown in FIG. 2, the steering assembly 60 includes a multi-function control arm 95 comprising a pair of telescoping tubes 96 and 97. More particularly, the tube 96 is capable of sliding within the inner diameter of the tube 97 and being locked into the desired position by a locknut 99. Specifially, the end of the tube 97 is slightly thickened, flared and slotted, such that upon tightening the locknut 99 the end of the tube 97 is compressed around the shaft 96 thereby locking the tube 96 in position relative to the tube 97. Thus, the tubes 96 and 97 provide a control arm 95 of adjustable length. This allows a user to adjust the length of the control arm 95 to meet the specific height requirements of the user and help to ensure that a user is properly spaced from the sail 29. Proper spacing with the sail 29 helps the user to avoid contact with the sail 29 as it swings from side to side.

The control arm 95 includes at its distal end a handgrip 102. The handgrip 102 allows a user to grasp and rotate the control arm 95 and also to swing the control arm 95.

Referring now to FIG. 3, the structure by which the steering assembly 60 is releasably connected to the linking assembly 80 is illustrated. More particularly, included at the proximate end of the lower end of the control arm 95 is a Hook's coupling or universal joint assembly 110 and a base 112 for attaching the steering assembly 60 to the deck 20 of the sailboat 15. The universal joint assembly 110 includes an upper fork or clevis 115 attached to the lower end of the control arm tube 97 and a lower fork or clevis 117 to which a shaft 119 is attached. Connecting the clevises 115 and 117 is a cross member 120. Preferably, as shown in FIG. 2, a rubber boot 123 is provided at the bottom of the tube 97 in order to help shield and protect the universal joint assembly 110 from the elements.

The shaft 119 extends through and is supported for rotation within the cylindrical bearing housing 118 of the base 112. The shaft 119 may be supported for rotation within the bearing housing 118 by any suitable means. The shaft has a top flange 120 which is supported atop a top flange 121 of the base 112.

The universal joint assembly 110 allows the control arm 95 to be swung in any direction without rotating the shaft 112. More particularly, the control arm 95 may be swung to any position within a hemisphere above the deck 20 without causing any rotational movement of the linking assembly 80 and the rudder 51. The shaft 119, and in turn the rudder 51, may only be rotated by rotating the control arm 95 about its longitudinal axis.

Although in the illustrated preferred embodiment the steering assembly 60 includes a universal joint assembly 110 to obtain the desired swinging movement of control arm 95, the present invention also contemplates the use of other devices which would allow the control arm 95 to swing or be laterally manipulated without any corresponding movement of the rudder 51 while providing for transmission of rotary motion from the control arm to the steering member 82. For example, a constant velocity joint assembly may be provided at the bottom end of control arm 95 instead of the universal joint assembly 110.

The shaft 119 has at its lower end a protruding square shaft or bar 130. The square bar 130 is releasably received within a square socket 135 formed within the center axle portion 136 of the steering member 82. Protruding from the outer diameter of the bearing housing 118, just below the underside of the deck 20, are a plurality of rectangular ears 138 that together in combination form a cross 140. The cross 140 is designed to be inserted within a cross shape opening formed in the wall of the deck 20 in the immediate proximity of the front steering member 82. The cross shape opening is substantially identical to a cross shape opening 142 formed at the aft end of the sailboat 15 as shown in FIG. 1.

The upper flange 121 of the base 112 has a radially outwardly protruding ear 150. The ear 150 has an opening for receiving a removable pin 154. To prevent loss of the pin when removed from the opening 152, the pin is attached to a chain 156 which in turn is connected to an eyelet 155 provided on the wide flange portion 120 at the upper end of the shaft 119.

The steering assembly 60 is attached to the deck 20 in a bayonet-like manner. More particularly, the steering assembly 60 is connected to the deck 20 and coupled to the steering member 82 by first centering the shaft 119 over the cross shape opening formed in the deck 20 above the steering member. The cross 140 formed by the ears 138 is then aligned with the cross shape opening in the wall of the deck while simultaneously aligning the square shaft 130 with the square socket 135. The square shaft 130 is then inserted into the socket 135 while the cross 140 is inserted into the cross shape opening until the underside of the base flange 121 comes to rest atop the deck. At this point the ears 138 of the cross 140 will be disposed beneath the bottom surface of the deck wall 20 so that the base 112 can then be rotated to rotate the cross out of alignment with the cross shape opening in the deck wall. Preferably the base 112 is rotated to align the opening in the ear 150 with an opening formed in the deck 20. The pin 154 may then be inserted through the thusly aligned openings to prevent the base from rotating and thereby secure the base 112 to the deck 20 with the shaft 119 engaged with the steering member 82.

The steering assembly 60 is easily removed from the steering member 82 by reversing the aforementioned steps. The easy removal of the steering assembly 60 allows the assembly alternatively to be utilized at the aft end of the sailboat 15 in the proximity of the rudder 51.

Referring now to FIG. 4, the structure for connecting the steering assembly 60 to the rear stearing member 84 in the proximity of the rudder 51 is illustrated. More particularly, formed in the center axle portion 155 of the rear steering member 84 is a square socket 157 for receiving the square bar 130 of the steering assembly 60. Coupling of the steering assembly 60 to the rear steering member 84 is effected in the same manner as the steering assembly 60 is coupled to the front steering member 82.

The rear steering member or wheel 84 has extending from the center axle portion 155 a pair of spaced flanges 160 which form a clevis slot for receiving the upper end of the rudder 51. Formed in the flanges 160 are slots 164 for cradling trunnions 168 provided at the upper end of the rudder 51. The rudder 51 may pivot rearwardly and upwardly in the event the rudder 51 should contact an obstruction in the water, although normally the weight of the rudder will cause the rudder to extend generally vertically downwardly into the water.

In FIG. 2 the steering linking assembly 80 is illustrated with the front and rear steering members 82 and 84 being of different configurations. If desired, a pair of identical wheels or steering members like the rear steering member 84 may be used. This would obviate the necessity of producing a second type of steering member 82. Of course, if the steering member 84 is used in place of the steering member 82, the flanges 160 of the steering member will have to be positioned forwardly so that they do not interfere with the rods 86 and 88 as the steering member rotates.

When the steering assembly 60 is located at the forward location (i.e., in the proximity of the sail control rig 65), the sailboat 15 may be operated by a user grasping in one hand the grip 102 and holding in the other hand the end of the sheet line 72. However, preferably, the user grasps the handgrip 102 with both hands and simultaneously holds onto the sheet line 72. This allows the user to apply a major portion of his or her weight to the control arm 95 and lean away from the sail 29, thereby helping the user to control the trim of the sailboat 15 and counterbalance any rotational forces created by wind acting upon the sail 29. Thus, when leaning away from the sail 29 the user may support his or herself with both hands on the control arm 95. The user is also able to readily adjust his or her position on the deck 20 and maintain a firm grasp on the grip 102 and utilize the control arm 95 for support, without being concerned about any corresponding movement of the rudder 51. More particularly, the universal joint assembly 110 ensures that the swing position of the control arm 95 does not have any effect (or only minimal effect) upon the position of the rudder 51. Thus, a user may quickly move to either the port or the starboard side of the sailboat 15, and help trim the sailboat 15 and maintain the sailboat's balance upon the water. Even if the user should be thrown off balance or lose his or her footing and be forced to change positions on the deck 20, no movement of the rudder 51 will occur as a result of the control arm 95 being swung upwardly or downwardly or from side to side. In order to alter the position of the rudder 51, the user must rotate the grip 102 by exerting a rotational force as shown by the arrow 175 in FIG. 1.

A user may readily alter the position of the sail 29 by pulling in or letting out the sheet line 72. When the sail 29 has been set as desired, the sheet line 72 may be secured in the locking cleat 74 provided on the control arm. When adjustment of the sail 29 is later needed, the sheet line 72 may be grasped and pulled initially to release it from the cleat 74 and then the sheet line 72 pulled in or let out as desired.

Since the lower block 73 of the block and tackle assembly 70 is located near the base of the control arm 95, the adjustment of the swing position of the control arm 95 by the user does not significantly impact upon the sheet line 72 when secured in the cleat 74 and, therefore, does not require any corresponding adjustment in the length of the sheet line 72. Also, since the locking cleat 74 is located on the control arm 95, altering the position of control arm 95 will not lead to an inadvertent release of the locking cleat 74.

Figure 5:
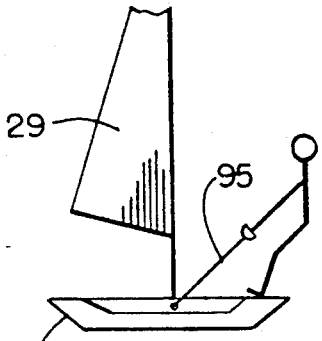
FIGS. 5 through 7 are schematic views of a sailboat made in accordance with the principles of the present invention with the control arm of the steering assembly located in various positions.
Figure 6:
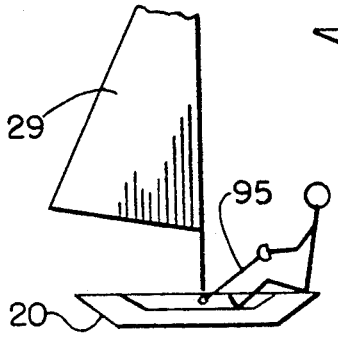
Figure 7:
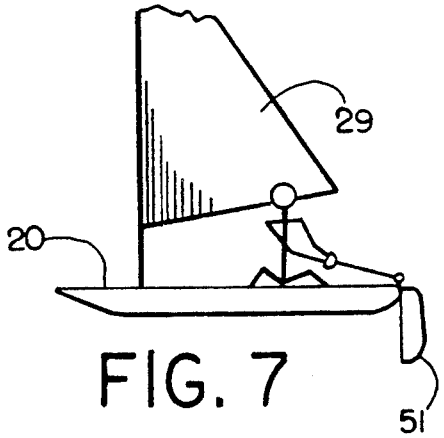

As schematically shown in FIGS. 5-7, a user may assume a variety of positions on the sailboat 15. More particularly, the user may be positioned on the starboard side of the sailboat 15 in a standing position leaning away from the sail 29 as shown in FIG. 5, or in a sitting position on the starboard side of the sailboat 15 as shown in FIG. 6. Alternatively, the user may couple the steering assembly 60 at its aft attachment location and sit forwardly of the attachment location to utilize the steering assembly 60 in a position somewhat like the position of a tiller on a conventional sailboat.

Since the steering assembly 60 is easily removed, a user may modify the sailboat 15 so as to allow the sailboat 15 to function in an alternative manner. More particularly, a user may remove the dagger board 45, the sail assembly 26, the rudder 51 and the steering assembly 60 and utilize the sailboat body 17 much like a surfboard.

Figure 8:
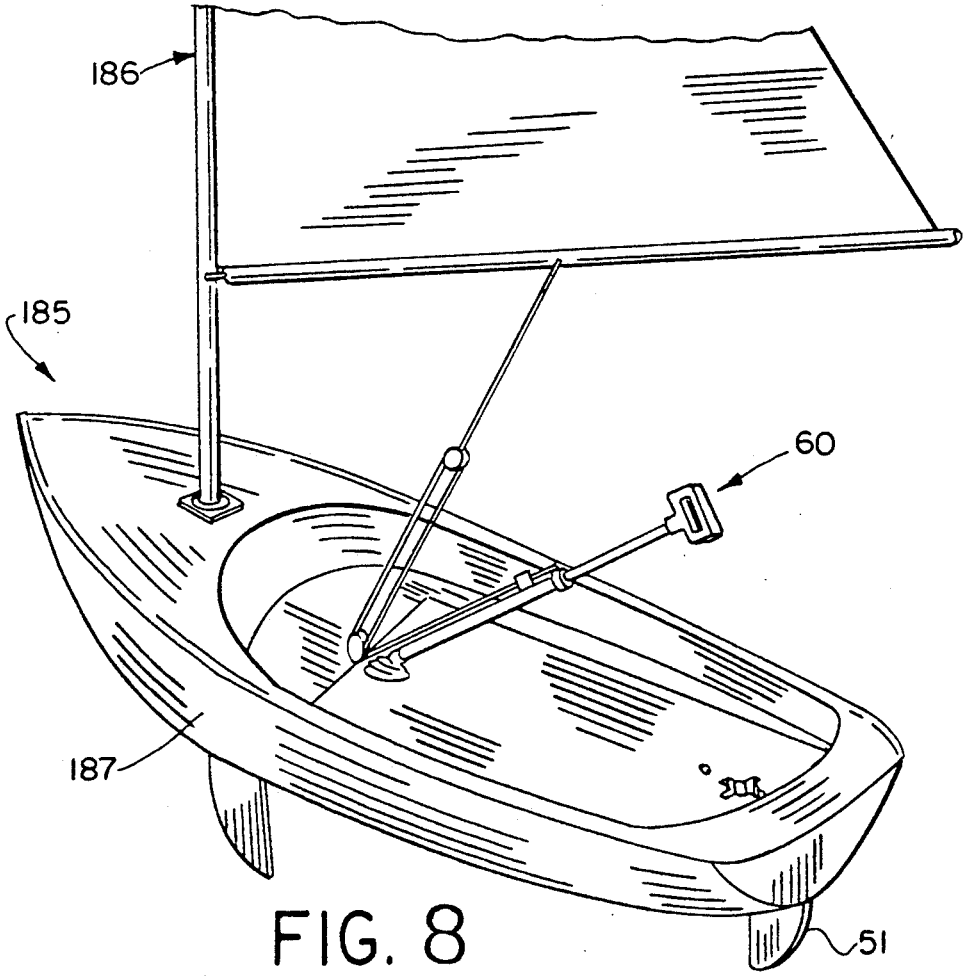
FIG. 8 is a perspective view of an alternative embodiment of the invention.
Figure 9:
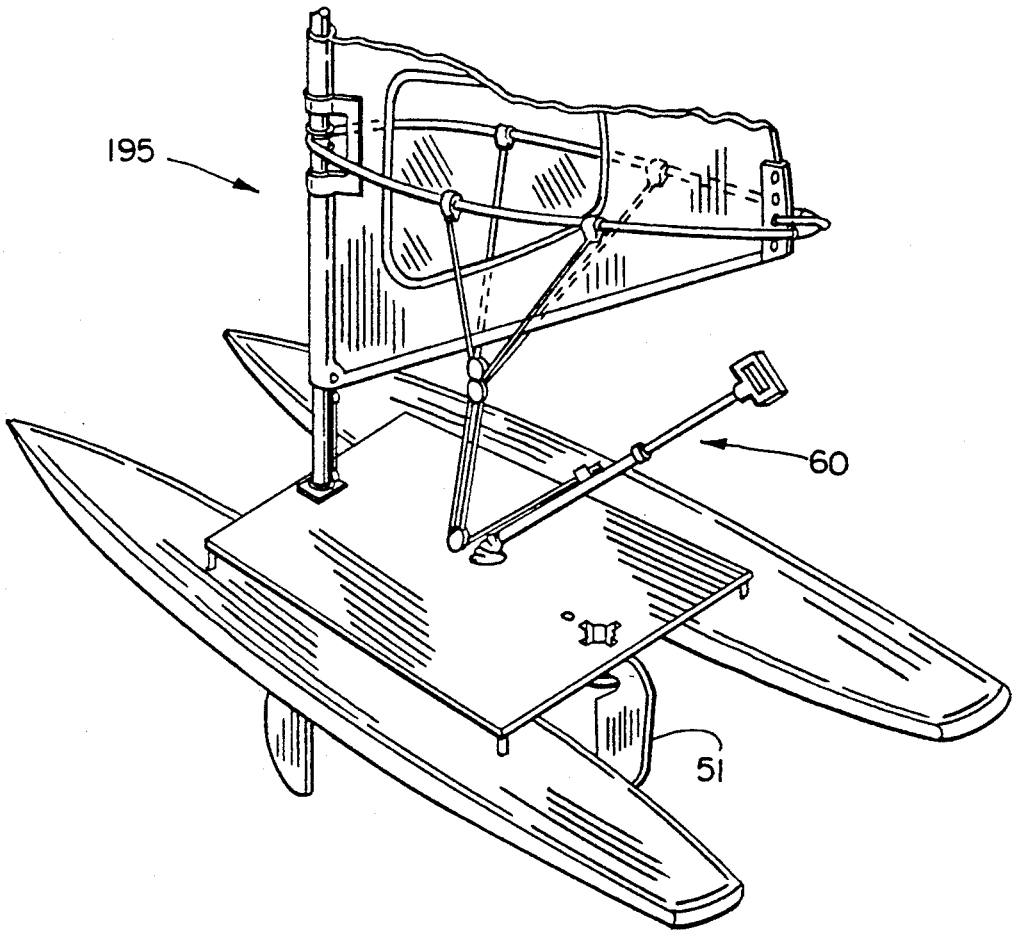
FIG. 9 is a perspective view of yet another alternative embodiment of the invention.

Referring now to FIGS. 8 and 9 it can be seen that principles of the present invention may be readily adapted to crafts having configurations much different than that of the sailboat 15 shown in FIG. 1. More particularly, illustrated in FIG. 8 is a sailboat 185 having a conventional sail and mast assembly 186 and a deepened hull 187 like that of a lake scow. The sailboat 185 includes a rudder control assembly having a steering assembly 60 for controlling the position of the rudder 51. Alternatively, illustrated in FIG. 9 is a catamaran 195 including a rudder control assembly having a steering assembly 60 for controlling the position of the rudder 51.

It will be appreciated that although each of the preferred embodiments illustrated above concern crafts for use upon water, the principles of the present invention may also be readily adapted to wind powered craft for use upon ice or land. For example, in the case of a craft for use upon ice, the rudder may take the form of a skate controlling the direction of the craft upon the ice. Alternatively, in the case of a craft for use on land, the rudder may be a turning wheel assembly having a wheel for contacting the land and controlling the direction of the craft.

Although the invention has been shown and described with respect to preferred embodiments, it is obvious that equivalent alterations and modifications will occur to others skilled in the art upon reading and understanding the specification. The present invention includes all such equivalent alterations and modifications, and is limited only by the scope of the following claims.

What is claimed is:

1. A wind propelled craft comprising a body having a deck for supporting a user of the craft, a sail attached to said body for propelling said body by wind forces, a rudder mounted to said body for turning movement for controlling the direction of movement of said body, a control arm having a free end engagable by a user on said deck and an opposite end connected to said deck, a rotatable steering member mounted to said body for rotation and operably connected to said rudder for turning said rudder upon rotation of said steering member, a connector connecting said opposite end of said control arm to said steering member for transmitting rotary motion from said control arm to said steering member while permitting horizontal and vertical swinging of said control arm independently of any movement of said steering member, a vertical mast for supporting said sail, said vertical mast extending substantially perpendicular to said deck of said body, and a second rotating steering member mounted to said body at a second location for rotation and operably connected to said rudder for turning said rudder upon rotation of said second steering member, said second steering member being adapted to receive and releasably connect to said control arm.

2. A wind propelled craft comprising a body having a deck for supporting a user of the craft, a sail attached to said body for propelling said body by wind forces, a rudder mounted to said body for turning movement for controlling the direction of movement of said body, a control arm having a free end engagable by a user on said deck and an opposite end connected to said deck, a rotatable steering member mounted to said body for rotation and operably connected to said rudder for turning said rudder upon rotation of said steering member, a connector connecting said opposite end of said control arm to said steering member for transmitting rotary motion from said control arm to said steering member while permitting horizontal and vertical swinging of said control arm independently of any movement of said steering member, and a vertical mast for supporting said sail, said vertical mast extending substantially perpendicular to said deck of said body, and wherein said rudder is positioned near and aft end of said body and said steering member is located between said vertical mast and said rudder so as to allow a user to be positioned on either side of said sail in the proximity of said sail during the operation of said craft.

3. A craft as set forth in claim 2 wherein said control arm is releasably connected to said deck and said steering member.

4. A craft as set forth in claim 2 wherein said control arm comprises a telescoping pair of tubes that allow the length of said control arm to be adjusted.

5. A craft as set forth in claim 2 wherin said rudder and mast are removable.

6. A craft as set forth in claim 2 including a sail control rig for controlling the position of said sail.

7. A craft as set forth in claim 2 including a removable keel.

8. A craft as set forth in claim 2 wherein said connector includes a universal joint.

9. A craft powered for movement by the wind comprising:

a body having an aft end, a fore end and a midsection located between said aft end and said fore end;

a deck which forms a substantially horizontal surface upon said body;

a rudder extending form said body for controlling the direction of travel of said craft; and a rudder control assembly for adjusting and controlling the position of said rudder;

said rudder control assembly including a linking assembly connected to said rudder and a steering assembly connected to said linking assembly, said linking assembly being adapted to releasably receive and engage said steering assembly at two separate locations along said deck, and wherein said linking assembly includes a pair of rotatable members located at least in part beneath said deck, one of said rotatable members being located at said aft end of said body and adapted to support said rudder, the other of said rotatable members being located in said midsection of said body, each of said rotatable members including an axle which extends through the center of said rotatable members substantially perpendicular to the major horizontal axis of said body, said axles being supported at their bottom ends by a bearing support and their top ends being adapted to releasably couple to said steering assembly.

10. A craft as set forth in claim 9 wherein said rudder is releasably attached to said linking assembly and is located at said aft end of said body.

11. A craft as set forth in claim 9 wherein said rotatable members of said linking assembly are connected by a pair of rods pivotally connected at their distal ends to said rotatable members, said rods serving to transmit rotational movement from said one rotatable member to said other rotatable member.

12. A craft as set forth in claim 9 wherein said one rotatable member located at said aft end of said body includes a pair of protruding flanges which form a channel for receiving and supporting said rudder.

13. A craft as set forth in claim 12 wherein said flanges each include aligned grooves that form a slot, said rudder including a trunnion which is cradled within said slot.

14. A craft as set forth in claim 9 wherein said steering assembly comprises a base for attachment to said deck and a control arm extending from said base, said control arm including at its distal end a grip for engagement by a user's hands and at its proximal end being connected to said base by a universal joint assembly, said universal joint assembly serving to allow a user to manipulate said control arm throughout an entire hemisphere of positions without causing any corresponding movement of said linking assembly or said rudder.

15. A sailboat for use upon water comprising:

a hull for floating upon the water having a bow at the fore end of said hull, a stern located at the aft end of said hull, and a midsection located between said bow and said stern;

a deck which forms at least a part of the upper surface of said hull;

a vertical mast extending substantially perpendicular to said deck of said hull;

a sail supported at least in part by said vertical mast;

a rudder extending from said hull at the aft end of said hull and into the water for maneuvering said craft within the water; and a rudder control assembly for allowing a user of said sailboat to control and adjust the position of said rudder;

said rudder control assembly including a rotatable steering member mounted to said hull for rotation and operably connected to said rudder for controlling the position of said rudder, and a control arm having a free end engageable by a user on said deck and an opposite end connected to said steering member by a joint, said joint connecting said control arm to said steering member for transmitting rotary motion from said control arm to said steering member while permitting horizontal and vertical swinging of said control arm independently of any movement of said steering member, and said steering member being located between said vertical mast and said rudder.

16. A sailboat for use upon water comprising:

a hull for floating upon the water having a bow at the fore end of said hull, a stern located at the aft end of said hull, and a midsection located between said bow and said stern;

a deck which forms at least a part of the upper surface of said hull;

a vertical mast extending substantially perpendicular to said deck of said hull;

a sail supported at least in part by said vertical mast;

a rudder extending from said hull and into the water for maneuvering said craft within the water;

a rudder control assembly for allowing a user of said sailboat to control and adjust the position of said rudder;

said rudder control assembly including a linking assembly connected to said rudder and a steering assembly connected to said linking assembly for manipulating said linking assembly and controlling the position of said rudder, said steering assembly including a base for attachment to said deck and an elongated control arm extending at least in part above said deck, said control arm connected to said base by a universal joint, said universal joint connecting said control arm to said linking assembly for transmitting rotary motion from said control arm to said linking assembly while permitting horizontal and vertical swinging of said control arm independently of any movement of said linking assembly; and a sail control rig for controlling the set of said sail, said sail control rig including a block mounted in the proximity of said base of said steering assembly, a sheet having one end connected to said sail and an opposite free end passing through said block, and a locking cleat mounted on said control arm remote from said base of said steering assembly for releasably engaging said opposite free end of said sheet.

17. A sailboat for use upon water comprising:

a hull for floating upon the water having a bow at the fore end of said hull, a stern located at the aft end of said hull, and a midsection located between said bow and said stern;

a deck which forms at least a part of the upper surface of said hull;

a vertical mast extending substantially perpendicular to said deck of said hull;

a sail supported at least in part by said vertical mast;

a rudder extending from said hull and into the water for maneuvering said craft within the water; and a rudder control assembly for allowing a user of said sailboat to control and adjust the position of said rudder;

said rudder control assembly including a linking assembly connected to said rudder and a steering assembly connected to said linking assembly for manipulating said linking assembly and controlling the position of said rudder, said steering assembly including a base for attachment to said deck and an elongated control arm extending at least in part above said deck, said control arm connected to said base by a universal joint, said universal joint connecting said control arm to said linking assembly for transmitting rotary motion from said control arm to said linking assembly while permitting horizontal and vertical swinging of said control arm independently of any movement of said linking assembly, and wherein said base includes a bearing mounted in said hull, and said universal joint has one end connected to said control arm and an opposite end connected to a shaft supported in said bearing for rotation about an axis extending substantially perpendicular to said deck.

* * * * *